US006043747A

United States Patent [19]

Altenhofen

[11] Patent Number: 6,043,747

[45] Date of Patent: Mar. 28, 2000

[54] BABY MONITOR SYSTEM

[76] Inventor: Cynthia L. Altenhofen, 4455 D'Evereux Pl., Pensacola, Fla. 32504

[21] Appl. No.: 08/934,716

[22] Filed: Sep. 22, 1997

[51] Int. Cl.[7] ..... G08B 23/00

[52] U.S. Cl. ..... 340/573.1; 340/539; 600/534; 455/66

[58] Field of Search ..... 455/39, 128, 439, 455/66; 340/825.69, 573, 539, 573.1; 600/534

[56] References Cited

U.S. PATENT DOCUMENTS

| | | | |
|---|---|---|---|
| 5,166,502 | 11/1992 | Rendleman et al. | 235/492 |
| 5,210,532 | 5/1993 | Knoedler et al. | 340/825.69 |
| 5,280,635 | 1/1994 | Knoedler et al. | 455/128 |
| 5,471,658 | 11/1995 | Iacono | 455/128 |
| 5,471,667 | 11/1995 | Yamada | 455/351 |
| 5,512,804 | 4/1996 | Abrams et al. | 340/573 |
| 5,568,792 | 10/1996 | Lynch | 119/713 |
| 5,757,274 | 5/1998 | Slomowitz et al. | 340/573 |

*Primary Examiner*—Wellington Chin
*Assistant Examiner*—Isaak R. Jama
*Attorney, Agent, or Firm*—Joseph N. Breaux

[57] ABSTRACT

A baby monitor system that includes a parent unit and a baby unit that have a two-way radio frequency communications link established therebetween. The baby monitor system also includes a message storage mechanism that allows a care giver to record a soothing message for playback to the baby in response to activation of a play switch. Use of the recorded message allows the care giver to provide the baby with a soothing message even when the care giver is in an ambient noise environment, such as a shower, that could startle are irritate the baby.

16 Claims, 2 Drawing Sheets

BABY MONITOR SYSTEM

TECHNICAL FIELD

The present invention relates to baby monitors and more particularly to a baby monitoring system that includes a parent unit and a baby unit that have a two-way radio frequency communications link established therebetween and a message storage mechanism that allows a care giver to record a soothing message for playback to the baby in response to activation of a play switch; the parent unit including a waterproof parent unit housing having a snap closure microphone cover and a waterproof speaker grating; a parent unit central processing circuit positioned within the waterproof parent unit housing that includes a radio frequency transmitter and receiver circuit, an analog to digital microphone amplification circuit, a digital message memory, a digital to analog converter and a speaker drive circuit; a parent unit microphone in electrical connection with the parent unit central processing circuit; a waterproof volume control switch in electrical connection with the parent unit central processing circuit; a waterproof message record switch in electrical connection with the parent unit central processing circuit; a waterproof message playback switch in electrical connection with the parent unit central processing circuit; a waterproof direct talk switch in electrical connection with the parent unit central processing circuit; a waterproof on/off switch in electrical connection with the parent unit central processing circuit; a parent unit antenna in electrical connection with the parent unit central processing circuit; and a parent unit speaker in electrical connection with the parent unit central processing circuit; the baby unit including a baby unit housing including a baby unit speaker grating and a baby unit microphone grating; a baby unit central processing circuit including a radio frequency transmitter and receiver circuit, an analog to digital microphone amplification circuit, a digital to analog converter and a speaker drive circuit; a baby unit microphone in electrical connection with the baby unit central processing circuit; a baby unit volume control switch in electrical connection with the baby unit central processing circuit; a baby unit on/off switch in electrical connection with the baby unit central processing circuit; a baby unit antenna in electrical connection with the baby unit central processing circuit; and a baby unit speaker in electrical connection with the baby unit central processing circuit; the parent unit central processing circuit and the baby unit central processing circuit having a two way radio frequency communication link established therebetween; the parent unit central processing circuit being responsive to the waterproof message record switch in a manner to digitize a parent unit microphone signal from the parent unit microphone and store the digitized parent unit microphone signal in the digital message memory; the parent unit central processing circuit being responsive to the waterproof message playback switch in a manner to transmit a radio frequency signal corresponding to the digitized parent unit microphone signal in the digital message memory to the baby unit central processing circuit for playback on the baby unit speaker; the parent unit central processing circuit being responsive to the waterproof direct talk switch in a manner to transmit a radio frequency signal corresponding to the parent unit microphone signal to the baby unit central processing circuit for playback on the baby unit speaker.

BACKGROUND OF THE INVENTION

It is important for a care giver to monitor small infants and babies as closely as possible. Although it would be ideal to monitor the infant or baby constantly, it is difficult for a single care giver to accomplish such intensive monitoring without the assistance of specialized monitoring equipment. Although such specialized monitoring equipment can provide a care giver with information regarding the infant or baby's condition, the monitoring equipment typically does not provide the care giver with a means for comforting the child with a soothing message. It would be a particular benefit to care givers to have a baby monitor system that included a message storage mechanism that allowed the care giver to transmit a prerecorded soothing message to the infant or child when the care giver is in an environment, such as the shower, where ambient noises would tend to startle and disturb the infant or child. Because the care giver must shower or bath, it would also be a benefit to have a baby monitoring system that included a parent unit having a waterproof housing to allow the care giver to shower normally without having to forego use of the baby monitor system.

SUMMARY OF THE INVENTION

It is thus an object of the invention to provide a baby monitor system.

It is a further object of the invention to provide a baby monitor system that includes a message storage mechanism.

It is a still further object of the invention to provide a baby monitor system that includes a parent unit having a waterproof housing.

It is a still further object of the invention to provide a baby monitor system hat includes a parent unit and a baby unit that have a two-way radio frequency communications link established therebetween; the parent unit including a waterproof parent unit housing having a snap closure microphone cover and a waterproof speaker grating; a parent unit central processing circuit positioned within the waterproof parent unit housing that includes a radio frequency transmitter and receiver circuit, an analog to digital microphone amplification circuit, a digital message memory, a digital to analog converter and a speaker drive circuit; a parent unit microphone in electrical connection with the parent unit central processing circuit; a waterproof volume control switch in electrical connection with the parent unit central processing circuit; a waterproof message record switch in electrical connection with the parent unit central processing circuit; a waterproof message playback switch in electrical connection with the parent unit central processing circuit; a waterproof direct talk switch in electrical connection with the parent unit central processing circuit; a waterproof on/off switch in electrical connection with the parent unit central processing circuit; a parent unit antenna in electrical connection with the parent unit central processing circuit; and a parent unit speaker in electrical connection with the parent unit central processing circuit; the baby unit including a baby unit housing including a baby unit speaker grating and a baby unit microphone grating; a baby unit central processing circuit including a radio frequency transmitter and receiver circuit, an analog to digital microphone amplification circuit, a digital to analog converter and a speaker drive circuit; a baby unit microphone in electrical connection with the baby unit central processing circuit; a baby unit volume control switch in electrical connection with the baby unit central processing circuit; a baby unit on/off switch in electrical connection with the baby unit central processing circuit; a baby unit antenna in electrical connection with the baby unit central processing circuit; and a baby unit speaker in electrical connection with the baby unit central processing circuit; the parent unit central processing circuit and the baby unit central processing circuit having a two way radio frequency communication link established therebetween; the parent unit central processing circuit being responsive to the waterproof message record switch in a manner to digitize a parent unit microphone signal from the parent unit microphone and store the digitized parent unit microphone signal in the digital message memory; the parent unit central processing circuit being responsive to the waterproof message playback switch in a manner to transmit a radio frequency signal corresponding to the digitized parent unit microphone signal in the digital message memory to the baby unit central processing circuit for playback on the baby unit speaker; the parent unit central processing circuit being responsive to the waterproof direct talk switch in a manner to transmit a radio frequency signal corresponding to the parent unit microphone signal to the baby unit central processing circuit for playback on the baby unit speaker.

It is a still further object of the invention to provide a baby monitor system that accomplishes some or all of the above objects in combination.

Accordingly, a baby monitor system is provided. The baby monitor system includes a parent unit and a baby unit that have a two-way radio frequency communications link established therebetween; the parent unit including a waterproof parent unit housing having a snap closure microphone cover and a waterproof speaker grating; a parent unit central processing circuit positioned within the waterproof parent unit housing that includes a radio frequency transmitter and receiver circuit, an analog to digital microphone amplification circuit, a digital message memory, a digital to analog converter and a speaker drive circuit; a parent unit microphone in electrical connection with the parent unit central processing circuit; a waterproof volume control switch in electrical connection with the parent unit central processing circuit; a waterproof message record switch in electrical connection with the parent unit central processing circuit; a waterproof message playback switch in electrical connection with the parent unit central processing circuit; a waterproof direct talk switch in electrical connection with the parent unit central processing circuit; a waterproof on/off switch in electrical connection with the parent unit central processing circuit; a parent unit antenna in electrical connection with the parent unit central processing circuit; and a parent unit speaker in electrical connection with the parent unit central processing circuit; the baby unit including a baby unit housing including a baby unit speaker grating and a baby unit microphone grating; a baby unit central processing circuit including a radio frequency transmitter and receiver circuit, an analog to digital microphone amplification circuit, a digital to analog converter and a speaker drive circuit; a baby unit microphone in electrical connection with the baby unit central processing circuit; a baby unit volume control switch in electrical connection with the baby unit central processing circuit; a baby unit on/off switch in electrical connection with the baby unit central processing circuit; a baby unit antenna in electrical connection with the baby unit central processing circuit; and a baby unit speaker in electrical connection with the baby unit central processing circuit; the parent unit central processing circuit and the baby unit central processing circuit having a two way radio frequency communication link established therebetween; the parent unit central processing circuit being responsive to the waterproof message record switch in a manner to digitize a parent unit microphone signal from the parent unit microphone and store the digitized parent unit microphone signal in the digital message memory; the parent unit central processing circuit being responsive to the waterproof message playback switch in a manner to transmit a radio frequency signal corresponding to the digitized parent unit microphone signal in the digital message memory to the baby unit central processing circuit for playback on the baby unit speaker; the parent unit central processing circuit being responsive to the waterproof direct talk switch in a manner to transmit a radio frequency signal corresponding to the parent unit microphone signal to the baby unit central processing circuit for playback on the baby unit speaker.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
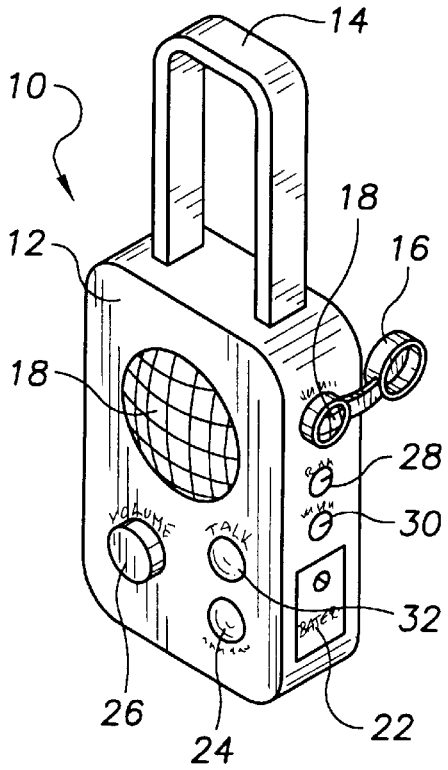
FIG. 1 is a perspective view of an exemplary embodiment of the parent unit of the baby monitor system of the present invention showing the waterproof parent unit housing including the support handle, the snap closure microphone cover positioned in the open position, the parent unit microphone, the waterproof speaker grating, the screw fastened waterproof battery compartment cover, the waterproof on/off switch, the waterproof volume control switch, the waterproof message record switch, the waterproof message playback switch, and the waterproof direct talk switch.
Figure 2:
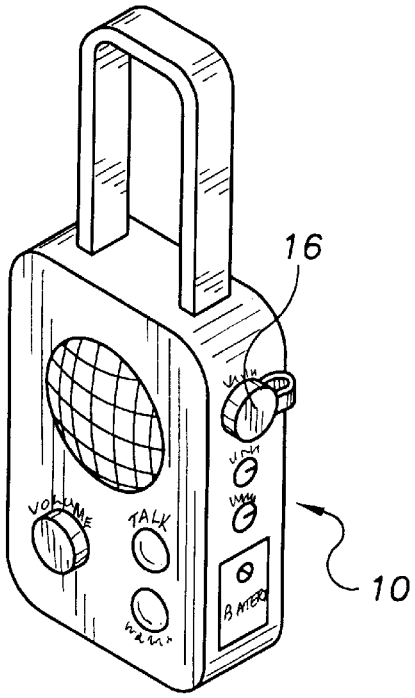
FIG. 2 is a perspective view of the exemplary parent unit of FIG. 1 with the snap closure microphone cover in the closed position providing a watertight seal over the parent unit microphone.
Figure 3:
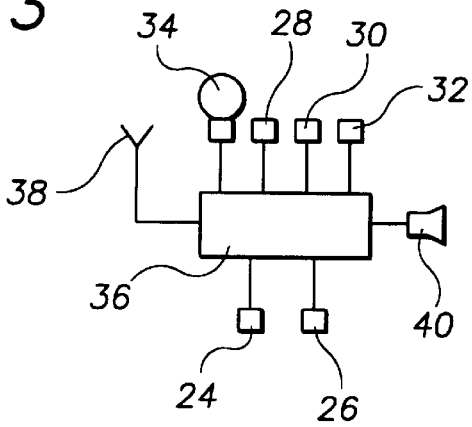
FIG. 3 is a schematic diagram of the exemplary embodiment of the parent unit of FIG. 1 showing the parent unit central processing circuit including a radio frequency transmitter and receiver circuit, an analog to digital microphone amplification circuit, a digital message memory, a digital to analog converter and a speaker drive circuit; the parent unit microphone in electrical connection with the parent unit central processing circuit; the waterproof, momentary contact type, volume control switch in electrical connection with the parent unit central processing circuit; the waterproof, momentary contact type, message record switch in electrical connection with the parent unit central processing circuit; the waterproof, momentary contact type, message playback switch in electrical connection with the parent unit central processing circuit; the waterproof, momentary contact type, direct talk switch in electrical connection with the parent unit central processing circuit; the waterproof on/off switch in electrical connection with the parent unit central processing circuit; the parent unit antenna in electrical connection with he parent unit central processing circuit; and the parent unit speaker in electrical connection with the parent unit central processing circuit.

FIG. 1 shows an exemplary embodiment of the parent unit of the baby monitor system of the present invention generally designated by the numeral 10. In this embodiment, parent unit it includes a waterproof, molded plastic, parent unit housing, generally designated 12; that includes a U-shaped support handle 14, a flexible snap closure microphone over 16, a waterproof speaker grating 18, a microphone grating 18 and a screw fastened waterproof battery compartment cover 22; a momentary contact, waterproof on/off switch 24; a momentary contact, waterproof volume control switch 26; a momentary contact, waterproof message record switch 28; a momentary contact, waterproof message playback switch 30; a momentary contact, waterproof direct talk switch 32; with reference now to FIG. 3, a parent unit microphone 34; a parent unit central processing circuit 36; a parent unit antenna 38; and a parent unit speaker 40. With reference back to FIG. 1, parent unit speaker 40 is mounted within parent unit housing 12 and behind waterproof speaker grating 18. Parent unit microphone 34 is mounted within parent unit housing 12 and behind microphone grating 18. With reference to FIG. 2, flexible snap closure microphone cover 16 snaps over microphone grating 18 (FIG. 1) to seal microphone grating 18 and prevent moisture and water from damaging parent unit microphone 40 (FIG. 3) when parent unit 10 is used in the shower, bath or other wet environment.

Figure 4:
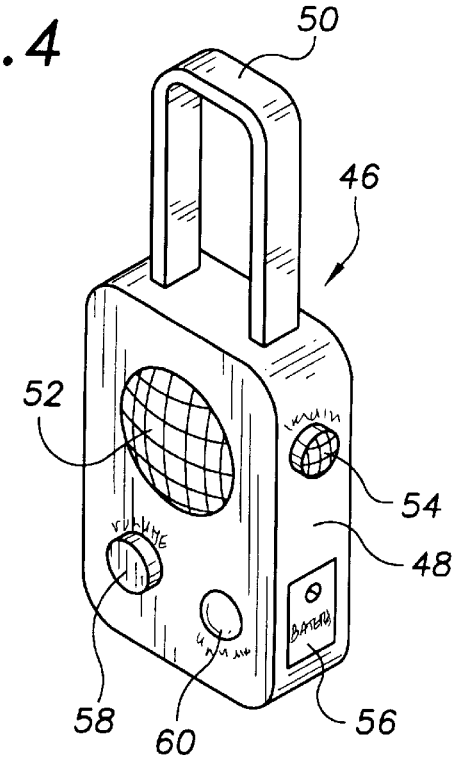
FIG. 4 is a perspective view of an exemplary embodiment of the baby unit of the baby monitor system of the present invention showing the molded plastic baby unit housing including the support handle, the baby unit speaker grating, the baby unit microphone grating, the screw fastened battery compartment cover, the baby unit volume control switch, and the baby unit on/off switch.
Figure 5:
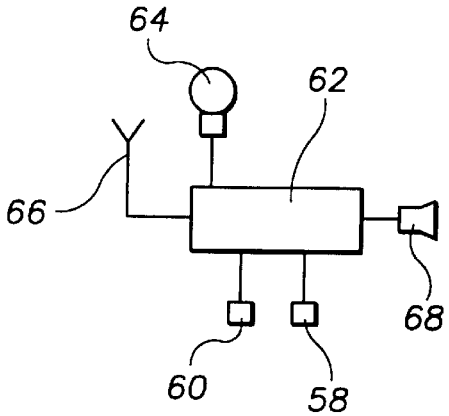
FIG. 5 is a schematic diagram of the exemplary embodiment of the baby unit of FIG. 4 showing the baby unit central processing circuit including a radio frequency transmitter and receiver circuit, an analog to digital microphone amplification circuit, a digital to analog converter and a speaker drive circuit; the baby unit microphone in electrical connection with the baby unit central processing circuit; the baby unit volume control switch in electrical connection with the baby unit central processing circuit; the baby unit on/off switch in electrical connection with baby unit central processing circuit; the baby unit antenna in electrical connection with the baby unit central processing circuit; and the baby unit speaker in electrical connection with the baby unit central processing circuit.

FIG. 4 shows an exemplary baby unit of the baby monitor system of the present invention generally designated by the numeral 46. Baby unit 46 includes a molded plastic baby unit housing 48 having a U-shaped support handle 50, a baby unit speaker grating 52, a baby unit microphone grating 54, a screw fastened battery compartment cover 56, a baby unit volume control switch 58, a baby unit on/off switch 60, with reference now to FIG. 5, a baby unit central processing circuit 62, a baby unit microphone 64, a baby unit antenna 66, and a baby unit speaker 68.

With general reference to FIGS. 1–5, parent unit and baby unit central processing circuits 36,62 each include a conventional radio frequency transmitter and receiver circuit, a conventional analog to digital microphone amplification circuit, a conventional digital to analog converter and a conventional speaker drive circuit. The radio frequency transmitter and receiver circuits of the parent unit and baby unit central processing circuits 36, 62 are complementarily tuned to establish a two way radio frequency communications link between parent unit 10 and baby unit 46.

In use baby unit 46 is used to monitor the sounds within the baby's environment and transmit those sounds for reproduction on parent unit speaker 40 of parent unit 10. If the care giver detects distress type sounds or wishes to soothe the baby, the care giver can establish a direct talk link with baby unit 46 by depressing talk switch 32 while talking into parent unit microphone 34. If the care giver is showering or in an otherwise noise intensive environment, the care giver can transmit a prerecorded soothing message to the baby by depressing play switch 28. The prerecorded message is recorded by depressing record switch 28 and speaking into parent unit microphone 34.

It can be seen from the preceding description that a baby monitor system has been provided that includes a message storage mechanism; that includes a parent unit having a waterproof housing; and that includes a parent unit and a baby unit that have a two-way radio frequency communications link established therebetween; the parent unit including a waterproof parent unit housing having a snap closure microphone cover and a waterproof speaker grating; a parent unit central processing circuit positioned within the waterproof parent unit housing that includes a radio frequency transmitter and receiver circuit, an analog to digital microphone amplification circuit, a digital message memory, a digital to analog converter and a speaker drive circuit; a parent unit microphone in electrical connection with the parent unit central processing circuit; a waterproof volume control switch in electrical connection with the parent unit central processing circuit; a waterproof message record switch in electrical connection with the parent unit central processing circuit; a waterproof message playback switch in electrical connection with the parent unit central processing circuit; a waterproof direct talk switch in electrical connection with the parent unit central processing circuit; a waterproof on/off switch in electrical connection with the parent unit central processing circuit; a parent unit antenna in electrical connection with the parent unit central processing circuit; and a parent unit speaker in electrical connection with the parent unit central processing circuit; the baby unit including a baby unit housing including a baby unit speaker grating and a baby unit microphone grating; a baby unit central processing circuit including a radio Frequency transmitter and receiver circuit, an analog to digital microphone amplification circuit, a digital to analog converter and a speaker drive circuit; a baby unit microphone in electrical connection with the baby unit central processing circuit; a baby unit volume control switch in electrical connection with the baby unit central processing circuit; a baby unit on/off switch in electrical connection with the baby unit central processing circuit; a baby unit antenna electrical connection with the baby unit central processing circuit; and a baby unit speaker in electrical connection with the baby unit central processing circuit; the parent unit central processing circuit and the baby unit central processing circuit having a two way radio frequency communication link established therebetween; the parent unit central processing circuit being responsive to the waterproof message record switch in a manner to digitize a parent unit microphone signal from the parent unit microphone and store the digitized parent unit microphone signal in the digital message memory; the parent unit central processing circuit being responsive to the waterproof message playback switch in a manner to transmit a radio frequency signal corresponding to the digitized parent unit microphone signal in the digital message memory to the baby unit central processing circuit for playback on the baby unit speaker; the parent unit central processing circuit being responsive to the waterproof direct talk switch in a manner to transmit a radio frequency signal corresponding to the parent unit microphone signal to the baby unit central processing circuit for playback on the baby unit speaker.

It is a still further object of the invention to provide a baby monitor system that accomplishes some or all of the above objects in combination.

It is noted that the embodiment of the baby monitor system described herein in detail for exemplary purposes is of course subject to many different variations in structure, design, application and methodology. Because many varying and different embodiments may be made within the scope of the inventive concept(s) herein taught, and because many modifications nay be made in the embodiment herein detailed in accordance with the descriptive requirements of the law, it is to be understood that the details herein are to be interpreted as illustrative and not in a limiting sense.

What is claimed is:

1. A baby monitor system comprising:

a parent unit; and a baby unit;

said parent unit including:

a waterproof parent unit housing having a snap closure microphone cover and a waterproof speaker grating;

a parent unit central processing circuit positioned within said waterproof parent unit housing that includes a radio frequency transmitter and receiver circuit including a parent unit antenna, an analog to digital microphone amplification circuit, a digital message memory, a digital to analog converter and a speaker drive circuit;

a parent unit microphone in electrical connection with said parent unit central processing circuit;

a waterproof volume control switch in electrical connection with said parent unit central processing circuit;

a waterproof message record switch in electrical connection with said parent unit central processing circuit;

a waterproof message playback switch in electrical connection with said parent unit central processing circuit;

a waterproof direct talk switch in electrical connection with said parent unit central processing circuit;

a waterproof on/off switch in electrical connection with said parent unit central processing circuit; and a parent unit speaker in electrical connection with said parent unit central processing circuit; said baby unit including:

a baby unit housing including a baby unit speaker grating and a baby unit microphone grating;

a baby unit central processing circuit including a radio frequency transmitter and receiver circuit including a baby unit antenna, an analog to digital microphone amplification circuit, a digital to analog converter and a speaker drive circuit;

a baby unit microphone in electrical connection with said baby unit central processing circuit;

a baby unit volume control switch in electrical connection with said baby unit central processing circuit;

a baby unit on/off switch in electrical connection with said baby unit central processing circuit; and a baby unit speaker in electrical connection with said baby unit central processing circuit;

said parent unit central processing circuit and said baby unit central processing circuit having a two way radio frequency communication link established therebetween;

said parent unit central processing circuit being responsive to said waterproof message record switch in a manner to digitize a parent unit microphone signal from said parent unit microphone and store said digitized parent unit microphone signal in said digital message memory;

said parent unit central processing circuit being responsive to said waterproof message playback switch in a manner to transmit a radio frequency signal corresponding to said digitized parent unit microphone signal in said digital message memory to said baby unit central processing circuit for playback on said a baby unit speaker;

said parent unit central processing circuit being responsive to said waterproof direct talk switch in a manner to transmit a radio frequency signal corresponding to said parent unit microphone signal to said baby unit central processing circuit for playback on said a baby unit speaker.

2. The baby monitor system of claim 1, wherein:

said baby unit includes a U-shaped support handle.

3. The baby monitor system of claim 1, wherein:

said parent unit includes a U-shaped support handle.

4. The baby monitor system of claim 1 wherein:

said waterproof parent unit housing is of molded elastic construction.

5. The baby monitor system of claim 1 wherein:

said waterproof message record switch is a momentary contact switch;

said waterproof message playback switch is a momentary contact switch; and said waterproof direct talk switch is a momentary contact switch.

6. The baby monitor system of claim 2, wherein:

said parent unit includes a U-shaped support, handle.

7. The baby monitor system of claim 2 wherein:

said waterproof parent unit housing is of molded plastic construction.

8. The baby monitor system of claim 2 wherein:

said waterproof message record switch is a momentary contact switch;

said waterproof message playback switch is a momentary contact switch; and said waterproof direct talk switch is a momentary contact switch.

9. The baby monitor system of claim 6 wherein:

said waterproof parent unit housing is of molded plastic construction.

10. The baby monitor system of claim 6 wherein:

said waterproof message record switch is a momentary contact switch;

said waterproof message playback switch is a momentary contact switch; and said waterproof direct talk switch is a momentary contact switch.

11. The baby monitor system of claim 9, wherein:

said parent unit includes a U-shaped support handle.

12. The baby monitor system of claim 7 wherein:

said waterproof message record switch is a momentary contact switch;

said waterproof message playback switch is a momentary contact switch; and said waterproof direct talk switch is a momentary contact switch.

13. The baby monitor system of claim 3 wherein:

said waterproof parent unit housing is of molded plastic construction.

14. The baby monitor system of claim 3 wherein:

said waterproof message record switch is a momentary contact switch;

said waterproof message playback switch is a momentary contact switch; and said waterproof direct talk switch is a momentary contact switch.

15. The baby monitor system of claim 13 wherein:

said waterproof message record switch is a momentary contact switch;

said waterproof message playback switch is a momentary contact switch; and said waterproof direct talk switch is a momentary contact switch.

16. The baby monitor system of claim 4 wherein:

said waterproof message record switch is a momentary contact switch;

said waterproof message playback switch is a momentary contact switch; and said waterproof direct talk switch is a momentary contact switch.

* * * * *